US009902540B2

(12) United States Patent
Hoffman

(10) Patent No.: US 9,902,540 B2
(45) Date of Patent: Feb. 27, 2018

(54) WRAPPING PAPER

(71) Applicant: Wrap Nation Limited, London (GB)

(72) Inventor: Gary Paul Hoffman, Shenley (GB)

(73) Assignee: Wrap Nation Limited, London (GB)

( * ) Notice: Subject to any disclaimer, the term of this patent is extended or adjusted under 35 U.S.C. 154(b) by 0 days.

(21) Appl. No.: 15/274,400

(22) Filed: Sep. 23, 2016

(65) Prior Publication Data

US 2017/0029184 A1 Feb. 2, 2017

Related U.S. Application Data

(63) Continuation of application No. PCT/IB2016/050795, filed on Feb. 15, 2016.

(30) Foreign Application Priority Data

Feb. 25, 2015 (GB) ..... 1503169.3

(51) Int. Cl.
*B65D 65/38* (2006.01)
*B65D 65/14* (2006.01)

(52) U.S. Cl.
CPC ..... *B65D 65/14* (2013.01)

(58) Field of Classification Search
CPC ..... B65D 65/14; B65D 75/08; B65B 11/00–11/585
USPC ..... 229/87.18, 87.19; 53/461–466; 206/460, 206/813
See application file for complete search history.

(56) References Cited

U.S. PATENT DOCUMENTS 284,297 A * 9/1883 Hartwell ..... B42D 15/08 229/75
2,008,984 A * 7/1935 Kenyon ..... C08J 7/047 427/209
2,047,269 A * 7/1936 Kallock ..... C09J 7/0257 427/209
2,096,352 A * 10/1937 Semonsen ..... B31D 1/0056 215/DIG. 2
2,364,297 A * 12/1944 James ..... B65D 65/06 229/87.19
2,579,481 A * 12/1951 Fenn ..... C09J 129/04 428/355 EN
3,355,092 A * 11/1967 Le Pain ..... B65D 5/62 229/87.19
3,560,247 A * 2/1971 Robinson ..... C09J 7/0257 428/350
3,790,069 A * 2/1974 Straccamore ..... B65D 5/62 229/116.5
4,744,509 A * 5/1988 Buchler-Dopheide . B42D 15/08 229/68.1
5,306,372 A * 4/1994 Hall ..... B32B 37/12 156/213
5,414,976 A * 5/1995 Richards ..... B65D 65/14 229/87.19

(Continued)

FOREIGN PATENT DOCUMENTS

DE 29821484 2/1999
GB 2292325 2/1996

*Primary Examiner* — Jes F Pascua
(74) *Attorney, Agent, or Firm* — Allen Dyer Doppelt & Gilchrist

(57) ABSTRACT

Wrapping paper having a printed side intended to face outwards when wrapped around an article, characterised in that the printed side is coated with a layer of remoistenable adhesive.

7 Claims, 2 Drawing Sheets

(56) References Cited

U.S. PATENT DOCUMENTS

| | | | | |
|---|---|---|---|---|
| 5,542,597 | A * | 8/1996 | Richards | B65D 65/14 229/116.5 |
| 5,794,631 | A * | 8/1998 | Sylvester | B65D 5/422 206/232 |
| 6,343,734 | B1 * | 2/2002 | Smith | B65D 65/14 229/87.19 |
| 6,638,602 | B2 * | 10/2003 | Itada | C09J 7/0239 428/161 |
| 8,387,346 | B1 * | 3/2013 | Coates | B65D 75/08 229/116.5 |
| 2002/0119292 | A1 * | 8/2002 | Venkatasanthanam | B29C 47/0021 428/174 |
| 2005/0276953 | A1 * | 12/2005 | Kitchin | B65D 65/14 428/195.1 |
| 2006/0060642 | A1 * | 3/2006 | Rosier | B65D 77/003 229/87.19 |
| 2009/0127322 | A1 * | 5/2009 | Miller | B65D 65/14 229/87.19 |
| 2010/0017313 | A1 * | 1/2010 | Mosenthiem | B42D 15/08 705/28 |
| 2010/0143574 | A1 | 6/2010 | Guilmette | |
| 2016/0101915 | A1 * | 4/2016 | Meighen | B65D 65/14 53/441 |

* cited by examiner

WRAPPING PAPER

CROSS-REFERENCE TO RELATED APPLICATIONS

This application is a continuation of International Application No. PCT/IB/050795, filed on Feb. 15, 2016, which claims the benefit of Great Britain Application Serial No. GB1503169.3, filed on Feb. 25, 2015, the contents of which applications are hereby incorporated by reference in their entirety.

FIELD OF THE INVENTION

This invention relates to wrapping paper.

BACKGROUND OF THE INVENTION

Gifts or presents are typically wrapped for the purpose of improving the experience of receiving them. The reasoning is that the wrapping conceals the contents of the package and maintains an element of surprise for the recipient whilst increasing the time taken to identify the contents.

The wrapping of presents is a time consuming but necessary procedure that varies in its difficulty depending on the shape of the contents to be wrapped. Typically wrapping paper is supplied either in sheets or on a roll. A suitable sheet of wrapping paper is cut to size to allow it to envelope the gift to which it is applied. The paper is typically plain white on one side and printed on the other with the intention being that the article is placed on the wrapping paper with the plain side facing the article. The wrapping paper is then gathered around the article and its extreme edges arranged to overlap one another to form a decorative tube of paper around the article.

It is conventional to then stick down the outer edge of the paper onto the folded under layer using adhesive tape. It is preferable to dispense the tape in advance to allow it to be easily applied, or to utilise a tape dispenser having a serrated edge to allow pieces of tape to be easily separated from the reel and then applied to the partially wrapped present.

After the formation of the tube of wrapping paper around the article, the exposed ends may be manipulated by folding them into a neat shape as tightly as possible to the dimensions of the article. Once suitably placed, the folded ends are again secured to the surrounding paper using adhesive tape.

More advanced gift wrappers can neatly wrap a regularly shaped article such as a cube or cuboid shaped box without the use of adhesive tape. This may be achieved by wrapping a single length of string around two of the dimensions of the package and tying its loose ends to one another in a bow. In other examples, decorative ribbon may be utilised instead of string but on each occasion, the fastening method is intended to retain the position of the wrapping paper relative to the contents.

SUMMARY OF THE INVENTION

The present invention seeks to simplify the process of wrapping an item.

According to a first aspect of the present invention, there is provided wrapping paper having a printed side intended to face outwards when wrapped around an article, characterised in that the printed side includes a layer of remoistenable adhesive.

According to a second aspect of the present invention, there is provided a method of wrapping an article, the wrapping paper having at least one side having a layer of remoistenable adhesive, comprising the steps of, providing a sheet of wrapping paper dimensioned to envelope the article, folding free edges of the paper over the item to cause the edges of the wrapping paper to overlap one another, moistening at least one portion of the wrapping paper overlapping an opposing portion, and pressing together the portions to enable the remoistenable adhesive on at least one surface of the wrapping paper to adhere the overlapping portions to one another.

According to a third and final aspect of the present invention, there is provided an article wrapped in sheet of wrapping paper wherein the outward facing side of the wrapping paper includes a layer of remoistenable adhesive.

The invention will now be described further by way of example with reference to the accompanying drawings in which FIGS. 1 to 5 show the various stages of wrapping a regular shaped item in a sheet of wrapping paper and by the method of the present invention.

DETAILED DESCRIPTION OF PREFERRED EMBODIMENTS

Figure 1:
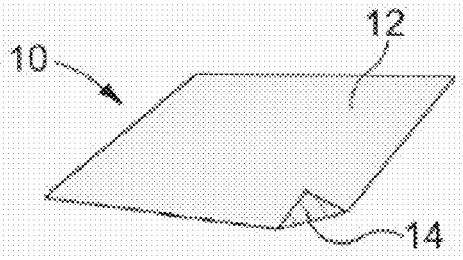
FIG. 1 is a perspective view of a sheet of wrapping paper, according to an aspect of the present invention.

Starting at FIG. 1, the diagram shows a sheet of wrapping paper 10 according to an aspect of the present invention. In the example shown the paper 10 has a blank upward facing side 12 and a decorative printed surface 14. In the diagram, a corner of the paper is folded upwards to show the hatching of the lower surface intended to indicate a decorative side. Wrapping paper is typically though not exclusively made in this way, having a blank surface 12 intended to face an article to be wrapped. The printed surface 14 is typically colourful and appealing to the recipient of the gift. It may also include a topical greeting such as "Happy Anniversary" or "Happy Birthday". Note that for the purposes of this specification the use of the word "print" is intended to convey some form of decoration when compared with the raw sheet material of the wrapping paper. The decoration need not be applied by printing but by any mechanism that changes the appearance of at least that side of the sheet, eg. painting, stencilling, dyeing, embossing, stickering etc.

The paper 10 shown may be dispensed from a reel and cut to size (FIG. 6, step 100), sold in individual sheets, or sold on a roll to the end user. It differs from conventional wrapping paper in that at least the decorative or printed surface 14 is coated with a remoistenable adhesive. Typically the weight of the glue application is approximately 8 to 12 g per square meter, such as 9, 10, or 11 g per square meter, for example approximately 10 g per square meter. The remoistenable glue is known in its use on stamps and envelopes wherein the adhesive qualities are activated by licking, though a wet sponge or the like may equally be used. It is additionally significant to note that the "paper" may not be made of paper but may be made of any suitable plastics material, such as cellophane.

In one embodiment the wrapping paper is paper.

In one embodiment the wrapping paper is plastic material.

In one embodiment the wrapping paper is foiled.

In one embodiment the wrapping paper is glittered.

In one embodiment the wrapping paper is holographic.

In one embodiment the wrapping paper is paper and has a weight of approximately 70 to 130 g per square meter, such as 75, 80, 85, 90, 95, 100, 105, 110, 115, 120 or 125 g per square meter.

Conventional remoistenable adhesives for use as adhesives on envelopes have generally been prepared from either of two adhesive systems. The first class of adhesives are those prepared by the addition of dextrin, plasticizer and other additives to dextrin emulsified vinyl acetate homopolymers; the second class are based primarily on homo- or copolymers of polyvinyl acetate which has been emulsified with polyvinyl alcohol and to which additional polyvinyl alcohol and plasticizer are post-added.

In one embodiment the adhesive is of the first class type described above.

In one embodiment the adhesive is of the second class type described above.

Depending on the economies of scale relating to manufacturing process, one may choose from applying the adhesive to pre-printed paper or printing on top of pre-gummed paper (remoistenable adhesive is often referred to as gum).

There are reasons for considering either of the above options relating to quantities of a given print design required and the presentation sheet size in which the wrap will be sold.

If printing on pre-gummed paper, one needs to consider the effect on the ink and the adhesive. Of course it does not matter if the printed image is affected by activating the adhesive since any area of paper whose adhesive has been activated is expected to be invisible following adhesion to another surface of the paper.

Conversely, printing on top of the adhesive may result in reduced performance of the adhesive as a portion of the surface of the adhesive layer to which moisture is to be applied is obscured by the print. In order to combat this, it may be desirable to alter the image to reduce the area of adhesive that is blocked by the ink for example by reducing the pixel density. It may also be beneficial, though not essential to use a non-waterbased ink when printing on top of remoistenable adhesive.

Figure 3:
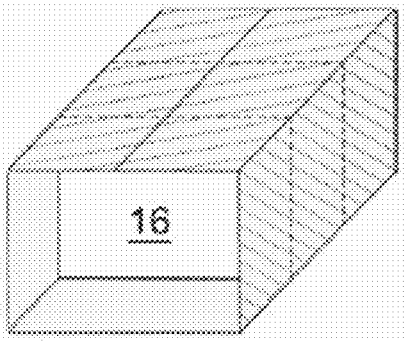
FIGS. 2-5 are perspective views of the sheet of wrapping paper of FIG. 1, in various stages of wrapping an article.
Figure 2:
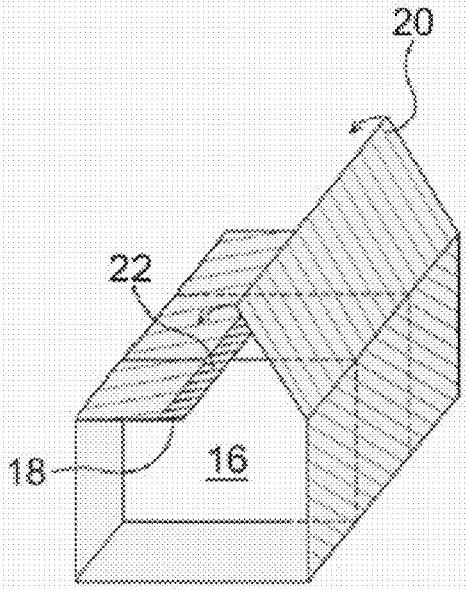
Figure 6:
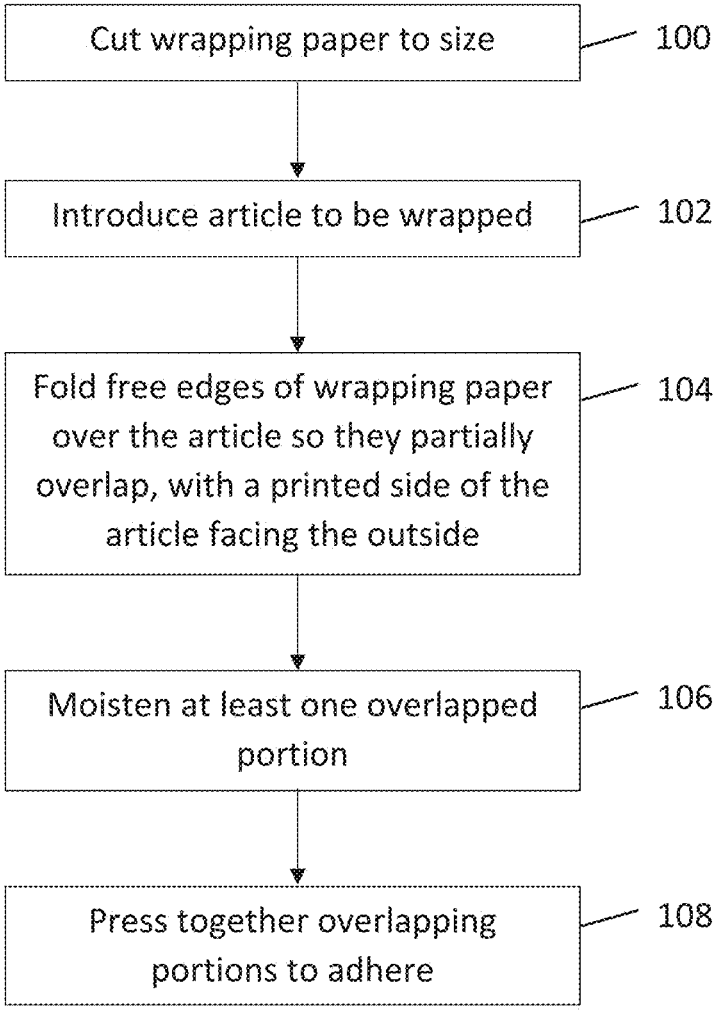
FIG. 6 is a flow diagram of a method of wrapping an article using wrapping paper, according to a method aspect of the present invention.

Returning to the task of wrapping an item, FIG. 2 shows the introduction of an article 16 intended to be wrapped (FIG. 6, step 102). In much the same way as when wrapping by the conventional method, the free edges 18 and 20 are drawn around and over the article 16 so that they partially overlap one another on the upper surface of the article presenting the printed surface 14 to the outside of the article (FIG. 6, step 104). The diagram shows an overlapped portion 22 where when folded down, edge 20 obscures edge 18. This overlapped region 22 is moistened either by licking or by dampening with a wet sponge or cloth, brush (such as a paint brush or water brush) or water pen (FIG. 6, step 106). Each of these tools is considered a remoistening tool as employed herein. The edges of the paper are pressed into contact with one another and the now activated adhesive sticks them together (FIG. 6, step 108). This forms a continuous tube around the article as is more clearly seen in FIG. 3. The dotted lines on FIG. 3 represent the article 16 obscured from view by the wrapping paper 10.

Conventional wrapping paper would be applied in much the same way up until the point where the remoistenable adhesive is activated. In the prior art the two edges would be secured to one another using a piece of adhesive tape which would only secure the two edges 18 and 20 together over its own length leaving the remaining area of the overlapped edges unsecure and susceptible to catching and tearing the paper. By using a selectively activated adhesive, the entire overlapped length creates a perfect seem which envelopes the article 16 much more securely. This is achievable by activating the adhesive only on the outer surface of the overlapped edge 18, in the event that the wrapping paper is of the embodiment having remoistenable adhesive only on the outer, decorative surface. The integrity of the bond may be improved by utilising a further embodiment in which both sides 12 and 14 are coated with a layer of remoistenable adhesive. This embodiment provides an additional advantage in that it gives more choice as to the area of adhesive that may be activated, further simplifying the process of wrapping.

In one embodiment the printed side 14 has a layer of remoistenable adhesive.

In one embodiment the non-printed side 12 has a layer of remoistenable adhesive.

In one embodiment both the printed 14 and the non-printed sides 12 have a layer of remoistenable adhesive.

Figure 4:
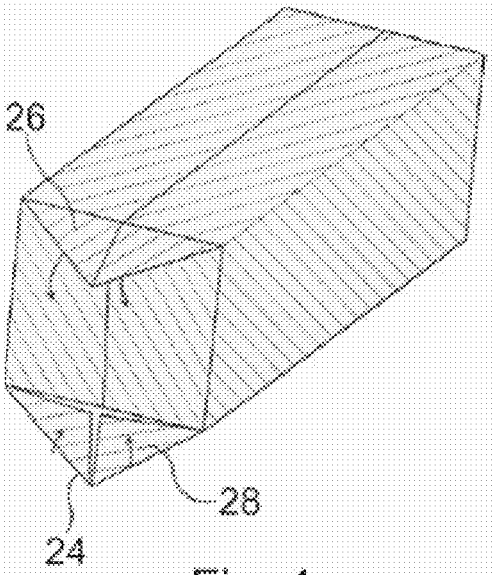

FIG. 4 shows the next stage of wrapping which, in its folding at least, is much the same as the way in which conventional wrapping paper is folded. This stage of the method is concerned with tidying up the loose "ends" of the tube shown in FIG. 3. This is achieved by folding down the loose ends extending from two opposing sides of the article, so that they lie flat against the article, entirely covering its end face. If there is some overlap between these loose ends, they may be secured to one another, again by licking, or dampening the overlapping area. In the process of folding down the opposing sides, two triangular shaped folded sections 24 and 26 are created. Neat wrapping of this side of the article may be completed by activating the remoistenable adhesive, shown by shaded area 28, on the article facing side of each of the triangular folded sections 24 and 26, and sticking them to the covered end faces of the wrapped article. The process applied in wrapping one end is then repeated on the opposite end not visible in the figures.

Figure 5:
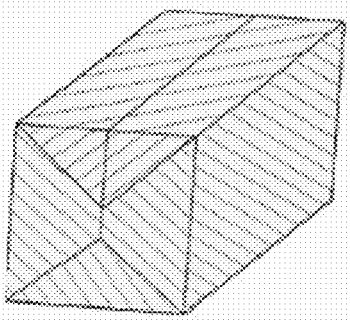

The result is a covered folded end, as shown in FIG. 5, much as would be created by conventional wrapping techniques albeit without any adhesive tape showing and with far greater adhesion between the relevant surfaces.

There are additional benefits to utilising wrapping paper according to the preferred embodiments. By application of adhesive to one or both sides, the feel and the weight of the paper is increased leading to a perception of greater quality. This enables the manufacturer to use a lighter weight paper prior to adhesive application. This has significant environmental as well as cost saving benefits but does not compromise the strength of the paper, which is important to its function as a wrapping paper. Additionally the resulting wrapped article does not display an unsightly adhesive tape making it more aesthetically pleasing. The environment benefits also by no longer using self-adhesive tape which is typically plastics based. In addition, since the gummed paper uses water based adhesive the paper remains easily recyclable. The wrapped article is also significantly more difficult to unwrap due to the integrity of the adhesive joins between overlapping areas of the paper. This results in increasing the time taken and therefore enjoyment of the unwrapping process.

The applicant has further recognised the additional benefits of flavouring the adhesive to improve the experience of wrapping an article. In conventional use of remoistenable adhesive, there has not been cause for the adhesive to be applied to anything other than a hidden and therefore blank or undecorated surface. The present invention requires that the adhesive is applied at least to the decorative or printed surface and therefore it is possible to add interest to the experience of wrapping. Specifically the flavour added to the adhesive may be a function of the area of the paper to which the adhesive is applied. For example, if the wrapping paper is printed with a design showing chocolate, vanilla and strawberry ice-cream, the adhesive in the relevant area may be flavoured accordingly. For obvious reasons, the remoistenable adhesive must be non-toxic.

In one embodiment the adhesive is flavoured.

Although the diagram shows a hashed side and a clear side for the purposes of distinguishing between the two sides, it is worth noting that both sides of the paper could be printed or decorated. The attached figures are pertinent to an embodiment in which both sides of the paper are decorated either similarly or with different finishes. In such an embodiment, the distinction in the figures is intended to enable the reader to distinguish between the sides for the purposes of determining where the adhesive is activated. In summary, the side 12 shown as blank may well be printed on, it is merely highlighted as being a side different from side 14. In FIGS. 1-5, remoistenable adhesive coating the sides 12, 14 and underlying any printing appearing thereon is schematically represented by shading.

In one embodiment one side 14 is printed.

In one embodiment both sides 12 14 are printed.

With regard to printing on both sides of the paper, any design may be considered, such as providing a grid for assisting in the wrapping process by providing a measure to help determine where the paper should be cut. Alternatively a decorative pattern may be printed on to give the user a choice of finishes from one purchased sheet of wrapping paper. This may include, for example, pink based colouring for a present for a newly born baby girl on one side and blue for a baby boy on the other side. Equally both sides of the paper may be decorated with the same printed design.

In the context of this specification "comprising" is to be interpreted as "including".

Aspects of the invention comprising certain elements are also intended to extend to alternative embodiments "consisting" or "consisting essentially" of the relevant elements.

Where technically appropriate, embodiments of the invention may be combined.

Embodiments are described herein as comprising certain features/elements. The disclosure also extends to separate embodiments consisting or consisting essentially of said features/elements.

Technical references such as patents and applications are incorporated herein by reference.

Any embodiments specifically and explicitly recited herein may form the basis of a disclaimer either alone or in combination with one or more further embodiments.

The invention claimed is:

1. A method of wrapping an article in wrapping paper, the wrapping paper having first and second sides, at least the first side entirely coated with a layer of remoistenable adhesive so as to enable any portion of the first side to be adhered to any overlapped portion of the wrapping paper, the method comprising the steps of:

providing a sheet of the wrapping paper dimensioned to envelop the article, folding free edges of the wrapping paper over the article to cause the wrapping paper to envelop the article, with the first side of the wrapping paper facing away from the article and the free edges of the wrapping paper overlapping one another with the second side facing the article, moistening at least one portion of the first side of the wrapping paper overlapping an opposing portion, and pressing together the overlapping portions to enable the remoistenable adhesive on the first side of the wrapping paper to adhere the overlapping portions to one another.

2. The method as claimed in claim 1, further comprising the step of cutting the sheet of wrapping paper to a size suitable for wrapping the article.

3. An article wrapped in a sheet of wrapping paper having first and second sides, the first side facing outward and the second side facing the article, wherein the first side of the wrapping paper is printed and entirely coated in a layer of remoistenable adhesive.

4. The article wrapped in a sheet of wrapping paper as claimed in claim 3, wherein the second side of the wrapping paper, in contact with the article, is also coated in a layer of remoistenable adhesive.

5. The article wrapped in a sheet of wrapping paper as claimed in claim 3, wherein the second side is also printed.

6. The article wrapped in a sheet of wrapping paper as claimed in claim 3, wherein the print on the first side is applied on top of the remoistenable adhesive layer coating the first side.

7. The article wrapped in a sheet of wrapping paper as claimed in claim 3, wherein the weight of remoistenable adhesive applied to at least one side of the wrapping paper is 10 $g/m^2$.

* * * * *